US005335678A

United States Patent [19]

Andersson

[11] Patent Number: 5,335,678

[45] Date of Patent: Aug. 9, 1994

[54] SMOKING COMPOSITION

[75] Inventor: Sven B. Andersson, Odakra, Sweden

[73] Assignee: Pharmacia AB, Stockholm, Sweden

[21] Appl. No.: 952,511

[22] PCT Filed: Jun. 3, 1991

[86] PCT No.: PCT/SE91/00385

§ 371 Date: Dec. 8, 1992

§ 102(e) Date: Dec. 8, 1992

[87] PCT Pub. No.: WO91/18525

PCT Pub. Date: Dec. 12, 1991

[30] Foreign Application Priority Data

Jun. 8, 1990 [FI] Finland ..... 9002052

[51] Int. Cl.[5] ..... A24B 15/18

[52] U.S. Cl. ..... 131/359; 131/369

[58] Field of Search ..... 131/359, 369

[56] References Cited

U.S. PATENT DOCUMENTS 3,047,431 7/1962 Bavley .
3,288,146 11/1966 Bavley .

FOREIGN PATENT DOCUMENTS 2275161 1/1976 France .

*Primary Examiner*—T. Brown
*Attorney, Agent, or Firm*—Fred Philpitt

[57] ABSTRACT

The invention is comprised of a smoking composition of nicotine in the form of an inclusion complex located between crylisized polysaccharide and nicotine and a smoking material. The composition releases nicotine when exposed to elevated temperatures.

5 Claims, No Drawings

SMOKING COMPOSITION

The present invention concerns a smoking composition with high nicotine content.

BACKGROUND OF THE INVENTION

Excessive smoking is now recognized as one of the major health problems throughout the world. The most advantageous thing a heavy smoker can do is, therefore, to reduce or preferably even stop smoking completely. Experience shows, however, that most smokers find this extremely difficult. It is generally accepted that this difficulty results from the fact that heavy smokers are dependent on nicotine, which is considered to be one of the risk factors in tobacco smoke. The most important risk factors, however are substances which are formed during the combustion of tobacco, such as carbon monoxide, tar products, aldehydes, and hydrocyanic acid. However, when trying to decrease tar and other harmful substances in the smoke by modifying the cigarette tobacco or using different filters it seems as if also the amount of nicotine is reduced For the smoker it is, generally undesirable to diminish the mount of nicotine as he tends to compensate the lower amount of nicotine with more intense smoking and deeper puffs. In the end it is therefore often so that the smoker inhales the sine mount of harmful components in spite of the fact that the cigarette is "cleaner". Therefore, if nicotine in a suitable fore could be incorporated in a tobacco product and if this nicotine was released by the heat from the glow and incorporated in the smoking particles this could perhaps supress the smoker's wish to increase the inhalation volumes. The consequence would then be that the amount of nicotine is unchanged while the mount of harmful substances is reduced.

SUMMARY OF THE INVENTION

The invention concerns a smoking composition wherein nicotine in the form of an inclusion complex formed between a cyclo compound and nicotine is incorporated into a smoking material such as ordinary tobacco, a nicotine-free herbal material or low tar tobacco. The cyclo compound is preferably a polysaccharide such as a $\alpha$-, $\beta$- or $\gamma$-cyclodextrin.

Cyclodextrins have previously been used in tobacco products. It is thus known from e.g. the U.S. Pat. No. 3,047,431 to incorporate flavoring materials in the form of inclusion complexes into tobacco materials. Cyclodextrins have also been suggested as additive to cigarette filter materials for absorption of nicotine and tar (cf DE 2 527 234 and JP 51032799).

The cyclodextrin inclusion complexes can be prepared according to methods well known to a person skilled in the art. The most common procedures comprise stirring or shaking of an aqueous solution of the particular cyclodextrin with the nicotine. The reaction is preferably carried out in a common solvent like water.

According to the invention the inclusion complex can be mixed with tobacco or a nicotine-free smoking material. Alternatively the complex is placed in a defined volume optionally in the form of plug in connection with a filter. It is also possible to have the inclusion complex in the form of a separate elongated tube along the inside of the cigarette paper or as a layer on the inside of the cigarette paper.

The invention is further illustrated by the following examples:

EXAMPLE 1

Preparation of inclusion complex of $\beta$-CD and nicotine ($\beta$-CD-N)

100 g water were heated to 75° C. 28 of $\beta$-CD were added and dissolved while stirring the solution. 3.5 ml of nicotine were added. The mixture was stirred for about 4 h at ambient temperature. The obtained mixture was filtered and dried in a drying oven at 35° C.

EXAMPLE 2

A conventional pipe was provided with herbal material obtained from Honeyrose de Luxe Herbal Cigarettes. This material is guaranteed nicotine-free according to the information on the cigarette package and was used in the present experiment in order to see if nicotine from the inclusion complex was actually released. If ordinary tobacco had been used it would have been difficult to estimate the amount of nicotine from the tobacco and the amount of nicotine from the inclusion complex. To the herbal material was added 60 mg of nicotine-$\beta$-cyclodextrin (equivalent to $60\times0{,}115=6{,}9$ mg of nicotine) and additional nicotine-free herbal material was packed on the complex. About 0,35 g of herbal material was used in each experiment. No inclusion complex was added in the control experiments.

The pipe was lit and air was drawn through the herbal material by using a gastight syringe. The whole mount of the herbal material including the inclusion complex was smoked in puffs of 50 ml by using the syringe. 15–18 puffs were drawn before the material was completely used up.

The smoke was conveyed through an aqueous solution of 10 ml of 0.05 M $H_2SO_4$ wherein the nicotine was trapped. The solution was analyzed with respect to nicotine and the following results were obtained:

| Exp. | Sample | Released nicotine/mg |
|---|---|---|
| 1 | herbal material + $\beta$-CD—N | 0,68 |
| 2 | herbal material + $\beta$-CD—N | 0,76 |
| 3 | herbal material | 0,08* |
| 4 | herbal material | 0,05* |

*resuidal nicotine from earlier experiments carried out in the equipment

The experiments 1 and 2 indicate that nicotine is released from the inclusion complex and is actually bound to the smoking particles when these are formed. If this had not been the case the nicotine had never reached the smoker but had condensed and been absorbed on the way through the pipe.

In the experiments 3 and 4 small amounts of nicotine were found. Most likely these amounts originates from earlier experiments involving nicotine carried out in the equipment.

I claim:

1. Smoking composition comprising nicotine in the form of an inclusion complex formed between a cyclisized polysaccharide and nicotine and a smoking material, which composition releases nicotine when it is subjected to elevated temperatures.

2. Composition according to claim 1 wherein the cyclisized polysaccharide is a cyclodextrin.

3. Composition according to claim 2 wherein the cyclodextrin is $\beta$-cyclodextrin.

4. Composition according to claim 1 wherein the smoking material is low tar tobacco.

5. A method of imparting nicotine to a smoking material comprising forming an inclusion complex between a cyclodextrin compound and nicotine and thereafter combining said smoking material with said inclusion complex whereby the nicotine is rendered stale within said smoking material until such time as the material is subjected to elevated temperatures.

* * * * *